United States Patent [19]

Yoshida

[11] 4,191,220

[45] Mar. 4, 1980

[54] WOVEN FASTENER STRINGER

[75] Inventor: Hiroshi Yoshida, Uozu, Japan

[73] Assignee: Yoshida Kogyo K.K., Tokyo, Japan

[21] Appl. No.: 972,429

[22] Filed: Dec. 22, 1978

[30] Foreign Application Priority Data

Dec. 29, 1977 [JP] Japan ..... 52-5389

[51] Int. Cl.[2] ..... D03D 1/00

[52] U.S. Cl. ..... 139/384 B; 24/205.16 C

[58] Field of Search ..... 139/384 B; 24/205.01 C, 24/205.13 C, 205.16 C

[56] References Cited

U.S. PATENT DOCUMENTS

| | | | |
|---|---|---|---|
| 3,807,462 | 4/1974 | Nogai | 139/384 B |
| 3,901,291 | 8/1975 | Nogai | 139/384 B |
| 3,921,679 | 11/1975 | Glindmeyer et al. | 139/384 B |
| 3,941,163 | 3/1976 | Glindmeyer | 139/384 B |
| 3,976,106 | 8/1976 | Porepp | 139/384 B |

FOREIGN PATENT DOCUMENTS

| | | | |
|---|---|---|---|
| 2333152 | 1/1975 | Fed. Rep. of Germany | 24/205.16 C |
| 2519829 | 11/1976 | Fed. Rep. of Germany | 24/205.16 C |
| 50-85445 | 7/1975 | Japan . | |

*Primary Examiner*—Henry Jaudon

*Attorney, Agent, or Firm*—Bucknam and Archer

[57] ABSTRACT

A woven fastener stringer has a row of successively interconnected coupling loops having a head, an upper leg, a lower leg and a heel. The row of loops is secured to a longitudinal edge of a woven stringer tape by a plurality of binding warp threads which are interwoven with a continuation of a foundation weft thread. The binding warp threads are pulled down when interwoven with the foundation weft thread in the spaces between each adjacent pair of loops and held in intimate contact with the upper legs so as to prevent the theads from slipping along the loops.

4 Claims, 7 Drawing Figures

WOVEN FASTENER STRINGER

BACKGROUND OF THE INVENTION

1. Field of the Invention

This invention relates to a slide fastener, and more particularly to a fastener stringer having a continuous plastic filament spirally formed and woven into an edge of a stringer tape during the weaving thereof by a needle loom.

2. Prior Art

There have been proposed a number of slide fasteners or zippers of the type described, which comprise a woven stringer tape and a plastic filament woven into a longitudinal edge of the tape, the filament being usually formed into a helical coil structure consisting of a row of successive elongated loops or convolutions each having a coupling head, an upper and a lower leg and a connecting portion.

Most of the known fasteners, however, have failed to meet with the requirements for the success of the so-called woven slide fasteners which largely depends upon the positional stability of the filament, i.e. coupling fastener element, with respect to the stringer tape against external stresses. When subjected to severe bending stresses in the transverse direction, the alignment or loop-to-loop pitch in the row of successive loops tends to be disturbed and the warp threads in particular holding the filament onto the tape are apt to shift out of place either toward the coupling head or toward the connecting or heel portion, which would in turn obstruct the movement of the slider and make it difficult to couple and uncouple the cooperating stringers.

SUMMARY OF THE INVENTION

According to the invention, there is provided, a woven fastener string comprising a woven tape formed with foundation warp and weft threads and consisting of a web section defining a major dimension of said tape and a woven filament section defining a longitudinal edge portion of said tape; a row of successively interconnected elongated loops woven into said filament section, each of said loops having a coupling head at one end thereof, an upper leg and a lower leg extending from said head in a common direction, and a heel portion at the opposite end remote from said head connected to a next adjacent one of said successive loops; a plurality of reinforcing cords extending longitudinally through said row of elongated loops; and a combination of a first group of binding warp threads extending over said upper legs and alternately overlying and underlying said foundation weft thread in the spaces between each adjacent pair of said loops, a second group of binding warp threads extending over said upper legs in parallel relation to said first group of binding warp threads and alternately overlying and underlying said foundation weft thread in the spaces between every other adjacent pair of said loops, said first and second groups of binding warp threads being engaged with said foundation weft thread at positions underlying said reinforcing cords.

It is therefore an object of the present invention to provide a slide fastener stringer which will eliminate the foregoing difficulties of the prior art.

A more specific object of the invention is to provide such a fastener stringer which has a row of successive coupling loops stably anchored in place against bending stresses.

Another specific object of the invention is to provide a fastener stringer having a coupling filament woven in such a manner that a slider can be moved smoothly along the row of coupling loops.

A further object of the invention is to provide a fastener stringer having a coupling filament woven into a longitudinal edge of the stringer tape in such a manner that the major portion of the filament is masked from external view.

Another related object of the invention is to provide a woven fastener stringer of the above character at an increased rate of production speed.

Many other advantages and features of the present invention will become manifest to those versed in the art upon making reference to the detailed description and the accompanying sheets of drawings in which preferred structural embodiments incorporating the principles of the present invention are shown by way of example.

BRIEF DESCRIPTION OF THE DRAWINGS

In the drawings wherein like reference numerals refer to like parts.

DETAILED DESCRIPTION OF THE PREFERRED EMBODIMENTS

Figure 1:
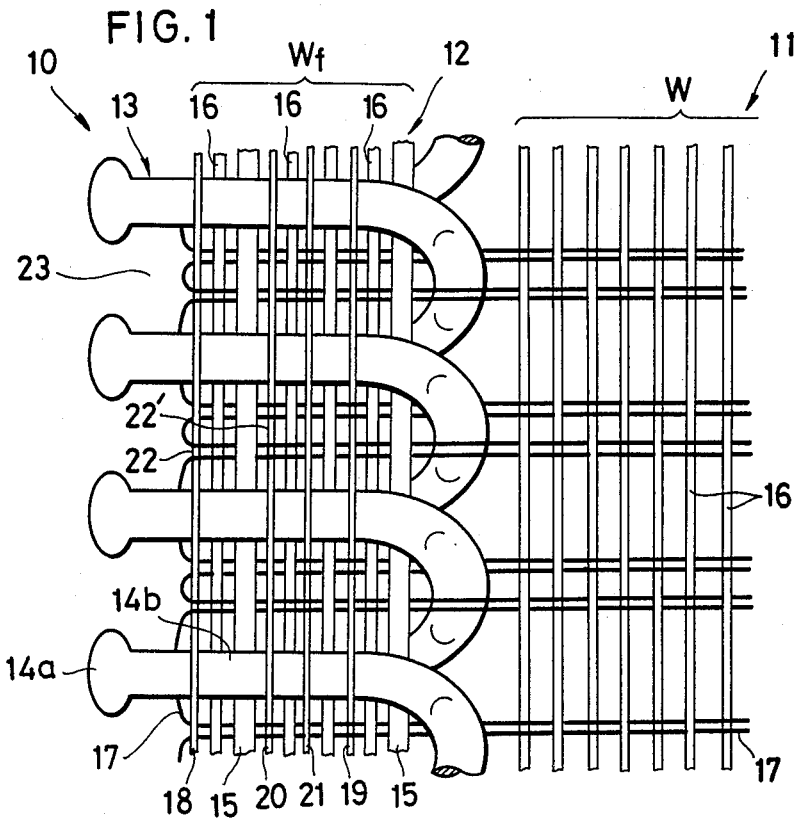
FIG. 1 is a plan view on enlarged scale of a portion of one of two identical fastener stringers according to one embodiment of the invention.
Figure 2:
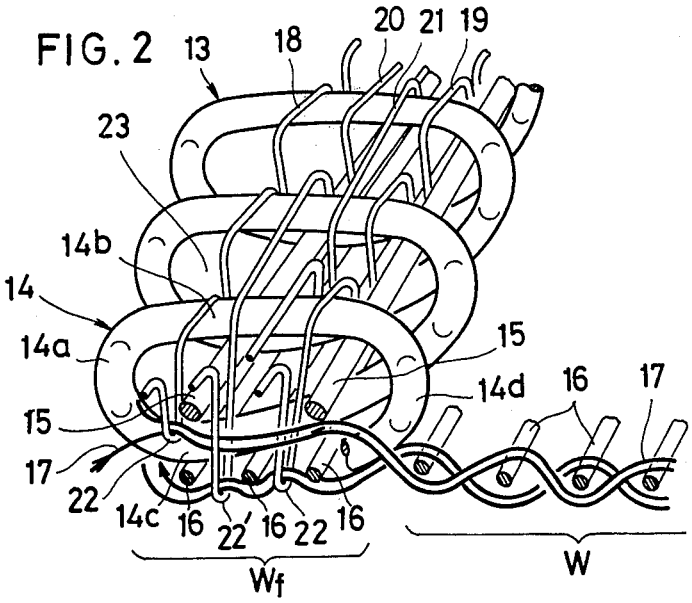
FIG. 2 is a diagrammatic, partly sectional perspective view of a segment of the portion of the fastener stringer shown in FIG. 1.

Referring now to FIGS. 1 and 2, which illustrate a first preferred embodiment of the invention, there is shown a fastener stringer generally designated 10 which constitutes one part of a pair of two identical stringers for a slide fastener. The stringer 10 consists of a generally flat web section W defining a major dimension of a woven tape 11 and a woven filament section $W_f$ defining a longitudinal edge portion 12 into which a filament 13 of plastic material is woven. The filament 13 is formed from a linear blank of a suitable plastic material into a helically coiled structure having a succession of loops or elongated convolutions. This is done during the course of weaving of the tape 11, for example in the manner disclosed in Japanese Laid-Open Publication No. 50-36250.

Each loop or elongated convolution 14 in the filament 13 has a coupling head **14*a* at one end thereof, an upper leg 14*b* and a lower leg 14*c* extending from the head 14*a* in a common direction and a heel portion 14*d* at the opposite end remote from the head 14*a* connected to a next adjacent one of the successive loops 14. The coupling head 14*a* is dimensioned to releasably couple with a corresponding head of a loop 14 on a mating stringer to open and close the fastener in the well known manner. The upper and lower legs 14*b* and 14*c* are spaced apart in substantially superimposed relation to each other as shown in FIG. 1 and define therebetween a longitudinally extending "tunnel" or hollow conduit through which a reinforcing string, cord or core 15** is inserted.

The web section W of the tape 11 may be of any known design having foundation warp threads 16 and foundation weft thread 17 interwoven in a variety of patterns, which will require no further explanation as this has no direct bearing upon the invention.

The term "filament woven section $W_f$" is used to define a longitudinal edge portion of the tape 11 into which the filament 13 serving as a coupling element for a slide fastener is woven. In addition to the foundation warp and weft system in the filament woven section $W_f$, there are provided a first group of binding warp threads 18 and 19 and a second group of binding warp threads 20 and 21, both groups of threads extending longitudinally of the tape 11 in parallel relation to one another as viewed in projection to the plane of the stringer 10.

The binding warp threads 18–21 all overlie the upper legs **14*b* of the loops 14 and are respectively interlaced with the foundation weft thread 17** in a manner hereafter to be described.

Each of the successive loops 14 of the coupling filament 13 has its lower leg **14*c* secured by the foundation warp threads 16 and weft 17 onto the woven filament section $W_f$. To stabilize the fixation of the successive loops 14 to the tape 11, the binding warp threads 18 and 19 in the first group are disposed adjacent to the coupling head 14*a* and the heel portion 14*d*, respectively, and interlaced with the foundation weft thread 17 in a plane defined commonly by the lower most surfaces of the lower legs 14*c* or at positions underlying the reinforcing cords 15 in the woven filament section $W_f$, as shown in FIG. 2. The second group of binding warp threads 20 and 21 are disposed centrally of the loops 14 intermediate the binding warp threads 18 and 19 in the first group and interlaced likewise with the foundation weft thread 17 at positions underlying the cords 15. While the junction 22 at which the first group of binding warp threads 18 and 19 are interlaced or joined with the foundation weft thread 17 is located in "inter-leg" spaces 23 between each adjacent pair of loops 14 of the filament 13, the junction 22' of interlacing of the second binding warp threads 20 and 21 is located in the "inter-leg" spaces 23 between every other pair of loops 14, in which instance the junction 22' of one thread 20 is shifted one loop pitch away with respect to the junction 22' of the other thread 21. In other words, each of the two binding warp threads 20 and 21 in the second group extends over the upper legs 14*b* of two successive loops 14 and comes into interlaced engagement with the foundation weft thread 17 in a next adjoining "inter-leg" space 24 and the junctions 22' of the respective binding warp threads 20 and 21 with the weft thread 17 in the woven filament section $W_f$ are not in the same "inter-leg" space 24 but alternate with respect to each other. In all instances, however, all binding threads 18–21 in the first and second groups are interlaced with the foundation weft thread 17 at positions underlying the cords 15, so that the loops 14 present themselves for their entire height above the upper surface of the tape 11. This, coupled with the fact that there exists no weave system on the upper legs 14*b* or at the heel portion 14*d*, will permit a slider (not shown) to move smoothly along the filament loops 14** in opening or closing the fastener, without woven threads being jerked in the slider channel.

As the binding warp threads 18–21 are all pulled down when interlaced with the foundation weft thread 17, they are held in intimate contact with the upper legs **14*b* of the loops 14 and thus prevented from slipping along the loops 14 either toward the coupling head 14*a* or toward the heel portion 14*d* even when the stringer 10** is flexed sharply transversely.

Figure 3:
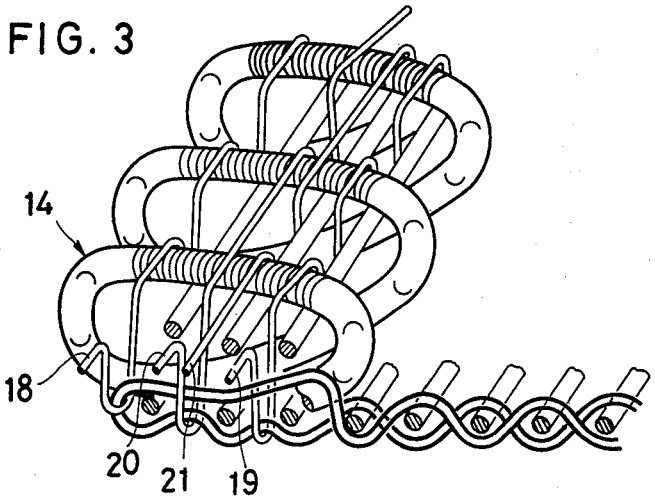
FIG. 3 is a view similar to FIG. 2 but showing another embodiment of the invention.

The embodiment shown in FIG. 3 is provided with a view to completely eliminating the tendency of the binding warp threads 18–21 to slip out of place along the loops 14. This is accomplished by the provision of a plurality of peripheral recesses in the upper legs **14*b* for receiving the binding warp threads 18–21**.

Figure 4:
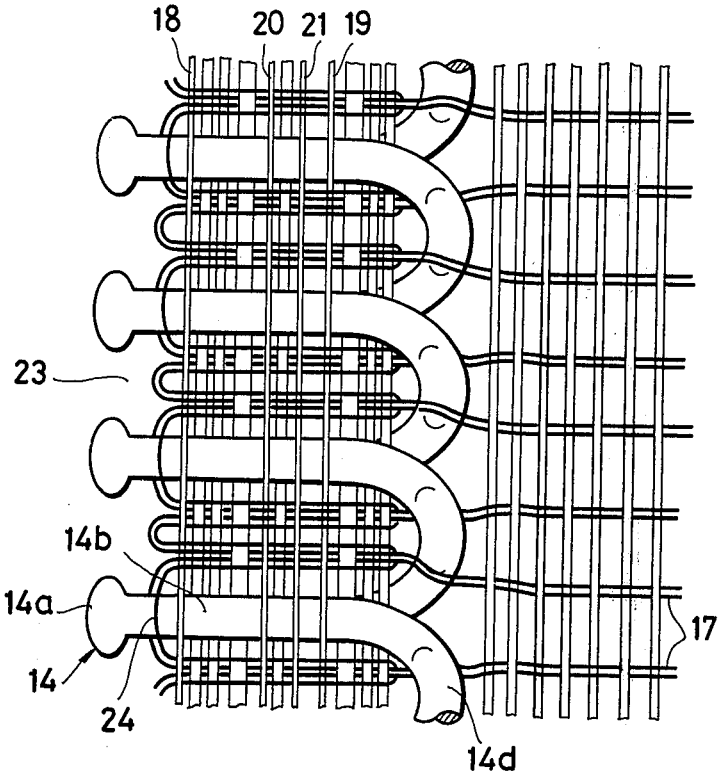
FIG. 4 is a view similar to FIG. 1 but showing a further embodiment of the invention.
Figure 5:
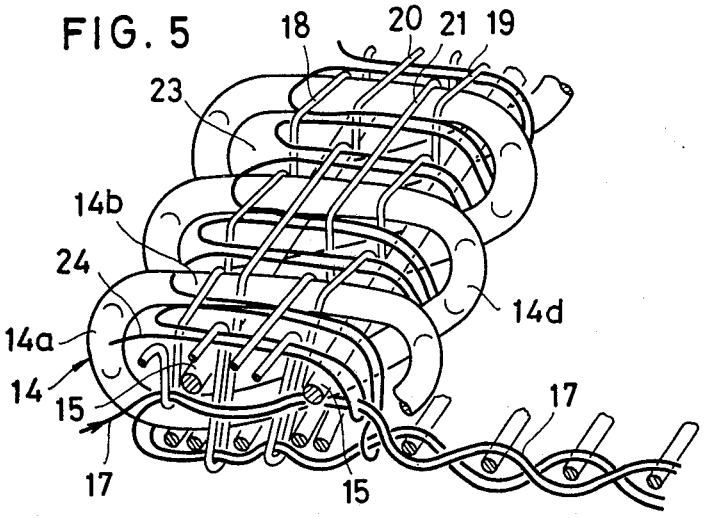
FIG.5 is a diagrammatic, partly sectional, perspective view of a segment of the fastener stringer shown in FIG. 4.

FIGS. 4 and 5 illustrate a modification of the embodiment shown in FIGS. 1 and 2, in which there is additionally provided a binding weft thread 24 which cooperates with the binding warp threads 18–21 in securing the loops 14 stably into position on the woven filament section $W_f$ of the stringer 10.

The binding weft thread 24 passes around the binding warp thread 18 adjacent to the coupling head **14*a* and loops around the foundation weft 17 at a position interiorly of the heel portion 14*d* which interconnects the upper leg 14*b* of one loop with the lower leg 14*c* of a next adjacent loop of the filament 13. On its return trip, the binding weft thread 24 passes alternately over and under the binding warp threads 18–21 in the "inter-leg" spaces 23 between each adjacent pair of loops 14**.

Figure 6:
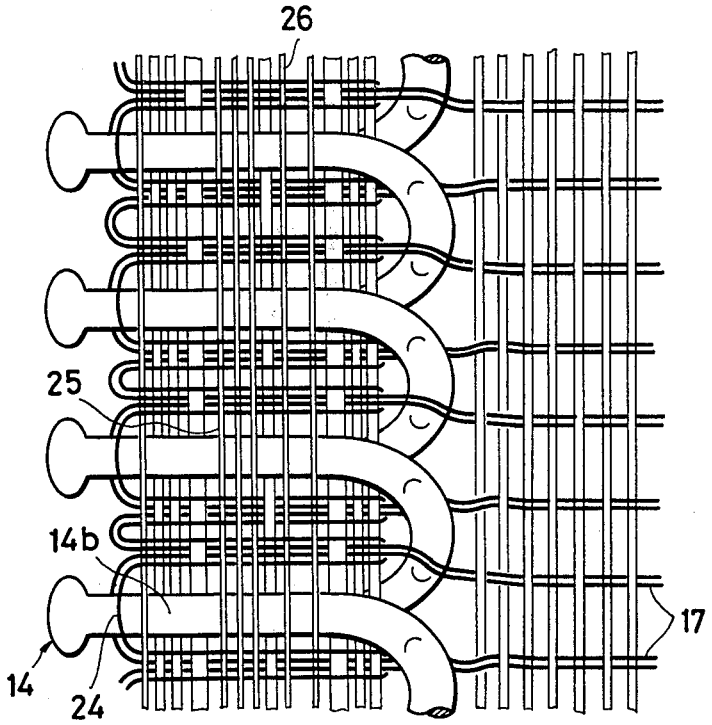
FIG. 6 is a view similar to FIG. 1 but showing still another embodiment of the invention.
Figure 7:
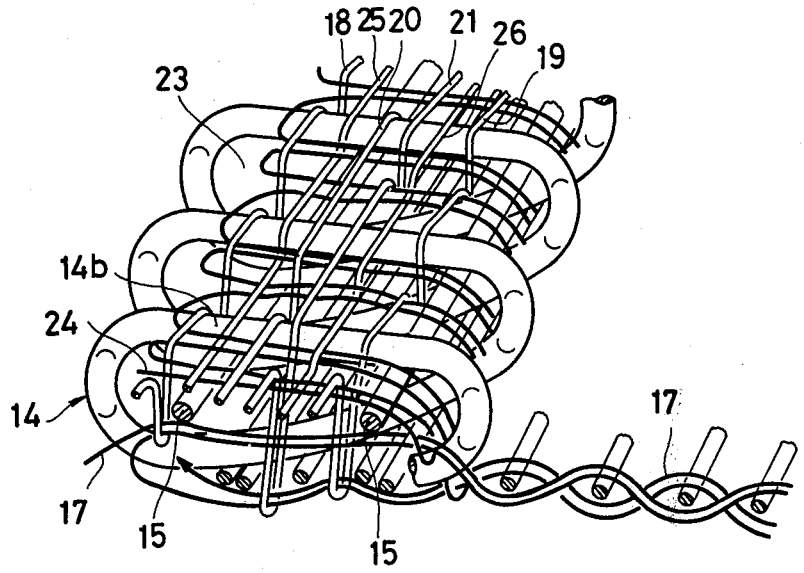
FIG. 7 is a diagrammatic, partly sectional, perspective view of a segment of the fastener stringer shown in FIG. 6.

FIGS. 6 and 7 illustrate another embodiment which is similar to the embodiment shown in FIGS. 4 and 5 but including additionally a plurality of supplemental binding warp threads 25 and 26 running in parallel with the binding warp threads 18–21 and interposed between the first group of threads 18 and 19, as shown. The supplemental warp threads 25 and 26 are not interengaged with the foundation weft 17 but are interlaced only with the binding weft thread 24 in a plane nearly flush with the common plane of the upper legs **14*b* of the successive loops 14 so that the path of the threads 25 and 26 is extended substantially flat over the upper legs 14*b***.

The supplemental warp threads 25 and 26, like the second group of threads 20 and 21 jumping over a plurality of the upper legs **14*b* of the loops 14, serve to make the woven filament section $W_f$ appear to the eyes somewhat homogeneous to the web section W of the stringer tape 11, and together with all binding warp threads 18–21, mask the major portion of the filament 13** from external view.

Although the junction of contact of the second group of binding warp threads 20, 21, with the foundation weft thread 17 is shown to exist in the inter-leg spaces 23 between every other adjacent pair of loops 14, it may exist between every three or more pairs of loops 14. Preferably, however, this should be every two or three adjacent pairs of loops 14.

Since the binding warp threads 18–21 are interlaced with the foundation weft thread 17 at positions underlying the cords 15, it is only required to perform the insertion of weft thread 17 (24) in addition to the warp motion of the loom without involving any other complicated weaving operation.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A woven fastener stringer comprising a woven tape formed with foundation warp and weft threads and consisting of a web section defining a major dimension of said tape and a woven filament section defining a longitudinal edge portion of said tape; a row of successively interconnected elongated loops woven into said filament section, each of said loops having a coupling head at one end thereof, an upper leg and a lower leg extending from said head in a common direction, and a heel portion at the opposite end remote from said head connected to a next adjacent one of said successive loops; a plurality of reinforcing cords extending longitudinally through said row of elongated loops; and a combination of a first group of binding warp threads extending over said upper legs and alternately overlying and underlying said foundation weft thread in the spaces between each adjacent pair of said loops, a second group of binding warp threads extending over said upper legs in parallel relation to said first group of binding warp threads and alternately overlying and underlying said foundation weft thread in the spaces between every other adjacent pair of said loops, said first and second groups of binding warp threads being engaged with said foundation weft thread at positions underlying said reinforcing cords.

2. A woven fastener stringer as defined in claim 1 wherein each of said loops is provided with recesses in its upper leg for receiving said binding warp threads.

3. A woven fastener stringer as defined in claim 1 further including a binding weft thread passing alternately over and under said binding warp threads in the spaces between each adjacent pair of said loops.

4. A woven fastener stringer as defined in claim 1 or 3 further including a plurality of supplemental binding warp threads interlaced with said binding weft thread in a plane substantially flush with the common plane of said upper legs.

* * * * *